US011352683B2

(12) United States Patent
De

(10) Patent No.: US 11,352,683 B2
(45) **Date of Patent: *Jun. 7, 2022**

(54) PRODUCTION OF HIC-RESISTANT PRESSURE VESSEL GRADE PLATES USING A LOW-CARBON COMPOSITION

(71) Applicant: ArcelorMittal, Luxembourg (LU)

(72) Inventor: Amar Kumar De, Munster, IN (US)

(73) Assignee: AcelorMittal, Luxembourg (LU)

( * ) Notice: Subject to any disclaimer, the term of this patent is extended or adjusted under 35 U.S.C. 154(b) by 0 days.

This patent is subject to a terminal disclaimer.

(21) Appl. No.: 16/995,983

(22) Filed: Aug. 18, 2020

(65) Prior Publication Data

US 2020/0377979 A1 Dec. 3, 2020

Related U.S. Application Data

(63) Continuation of application No. 14/615,125, filed on Feb. 5, 2015, now Pat. No. 10,829,839.
(Continued)

(51) Int. Cl.

| | |
|---|---|
| ***C22C 38/16*** | (2006.01) |
| ***C22C 38/04*** | (2006.01) |
| ***C22C 38/12*** | (2006.01) |
| ***C21D 8/02*** | (2006.01) |
| ***C22C 38/00*** | (2006.01) |

(Continued)

(52) U.S. Cl.
CPC ..... *C22C 38/16* (2013.01); *C21D 8/0226* (2013.01); *C21D 8/0263* (2013.01); *C22C 38/002* (2013.01); *C22C 38/02* (2013.01); *C22C 38/04* (2013.01); *C22C 38/06* (2013.01);
(Continued)

(58) Field of Classification Search
USPC ..... 148/332
See application file for complete search history.

(56) References Cited

U.S. PATENT DOCUMENTS 5,622,572 A * 4/1997 Wells, Jr ..... C21D 8/0263 148/320
2003/0106623 A1* 6/2003 Jeong ..... C22C 38/14 148/653

(Continued)

FOREIGN PATENT DOCUMENTS

EP 0940476 A1 9/1999
EP 2484784 A1 8/2012

(Continued)

OTHER PUBLICATIONS

Benscoter et al. "Metallography and Microstructures of Low-Carbon and Coated Steels." ASM Handbook, vol. 9: Metallography and Microstructure. 2004. pp. 588-607. (Year: 2004).*

*Primary Examiner* — Brian D Walck
(74) *Attorney, Agent, or Firm* — Davidson, Davidson & Kappel, LLC

(57) ABSTRACT

A lower carbon steel alloy with specific substitutional alloying additions. The alloy is useful in the production of ASTM A516 grade pressure vessel steel plates with excellent HIC resistance. The material has a ferrite-pearlite microstructure, in normalized and stress relieved condition, appropriate for resisting hydrogen induced cracking, with isolated ferrite and pearlite constituents and no continuous pearlite bands. The material exhibits significant low temperature toughness.

17 Claims, 6 Drawing Sheets

Related U.S. Application Data

(60) Provisional application No. 61/936,085, filed on Feb. 5, 2014.

(51) Int. Cl.
*C22C 38/02* (2006.01)
*C22C 38/06* (2006.01)
*C22C 38/08* (2006.01)

(52) U.S. Cl.
CPC ..... *C22C 38/08* (2013.01); *C22C 38/12* (2013.01); *C21D 2211/005* (2013.01); *C21D 2211/009* (2013.01)

(56) References Cited

U.S. PATENT DOCUMENTS

| | | | | |
|---|---|---|---|---|
| 2003/0121577 | A1* | 7/2003 | Choi | C21D 8/0226 148/653 |
| 2003/0131914 | A1* | 7/2003 | Jeong | C22C 38/06 148/541 |
| 2004/0144454 | A1* | 7/2004 | Jeong | C22C 38/60 148/654 |
| 2012/0031532 | A1* | 2/2012 | Ishikawa | C22C 38/04 148/541 |
| 2014/0137992 | A1 | 5/2014 | Ishiguro et al. | |

FOREIGN PATENT DOCUMENTS

| | | | |
|---|---|---|---|
| JP | 2013032584 | A | 2/2013 |
| RU | 2520603 | A | 3/2011 |
| RU | 2009134214 | A | 3/2011 |

* cited by examiner

Crack Length Ratio, $CLR = \frac{\sum a}{W} \times 100$

Crack Sensitivity Ratio, $CSR = \frac{\sum (a \times b)}{(W \times t)} \times 100\%$ Crack Thickness Ratio, $CTR = \frac{\sum b}{t} \times 100\%$

PRODUCTION OF HIC-RESISTANT PRESSURE VESSEL GRADE PLATES USING A LOW-CARBON COMPOSITION

CROSS-REFERENCE TO RELATED APPLICATIONS

This is a Continuation of U.S. patent application Ser. No. 14/615,125, filed Feb. 5, 2015 which claims the benefit of U.S. Provisional Patent Application 61/936,085, filed Feb. 5, 2014, both of which are hereby incorporated by reference herein.

FIELD OF THE INVENTION

The present invention relates generally steel alloys and plates formed therefrom. More specifically, the invention relates to Hydrogen Induced Cracking (HIC) resistant pressure vessel quality steels. Plates produced with the alloy exhibit excellent low temperature toughness after normalizing and stress relieving, as well as superior sour gas resistance.

BACKGROUND OF THE INVENTION

Hydrogen-induced cracking (HIC) resistant pressure vessel steel plates such as ASTM A516-60/65/70 grades are used as storage vessels in petroleum refineries and oil and gas processing units and many other applications requiring protection against corrosive actions of $H_2S$ gas. With the increasing exploration of natural oil and gas from sour reserves (rich in $H_2S$), demand for storage vessels for upstream processing units is on the rise and hence steel producing units are challenged with providing steels that offer outstanding resistance to absorbing hydrogen and hence hydrogen-induced delayed cracking. From a metallurgical standpoint, steels for sour service pressure vessels mandate excellent internal cleanliness in terms of elongated sulfide inclusions, centerline segregation, and shrinkage cavities as these are the key traps for hydrogen accumulation and recombination as molecular hydrogen. The mechanism of atomic hydrogen liberation on steel surfaces by wet sour gas, inward lattice diffusion and crack initiation at traps by accumulating hydrogen molecules has been well documented in the literature. It has been identified that stress gradients are known to provide driving force for atomic hydrogen diffusion to discontinuities such as crack tips, matrix-inclusion interfaces, and other regions of high stresses/triaxiality in steel components. Accordingly, steelmaking, steel refining and casting technologies have evolved by lowering sulfur contents to a safe minimum (<0.002 wt. % and <0.012 wt. % respectively), controlling the shape and type of inclusions (globularized through alloying with Ca), minimizing centerline segregation and shrinkage cavities (casting controls such as introduction of dynamic soft reduction) and containing the amount of dissolved hydrogen (controlled slow cooling of slabs) in the slabs.

Many steel mills worldwide are currently well equipped technologically to contain sulfur and treat sulfide inclusions so that HIC from sulfide inclusions is not much of a concern. The challenges to the production of HIC resistant pressure vessel steels are posed by the ability to contain centerline segregation and shrinkage cavities. Centerline segregation is directly related to the chemical composition of the steel such as carbon, manganese, sulfur, phosphorus and oxygen and is also primarily responsible for developing shrinkage cavities.

The following factors outline the issues involved with the successful production of HIC resistant pressure vessel steels.

Pressure vessel grade plates are typically supplied in normalized (and stress relieved if required by customer) condition and hence uses a higher carbon-equivalence to guarantee specified minimum mechanical properties in a plain ferrite-pearlite matrix. ASTM specification stipulates limited scope for microalloying (guided by ASTM A2010) thereby making it difficult for a low-carbon alloy design.

These plates are also used in thicker sections and hence allow limited mechanical deformation penetration at the middle of slabs during hot rolling. Shrinkage cavities, if present, are difficult to weld and remain vulnerable to atomic hydrogen accumulation.

Most importantly, thicker plate sections have delayed dehydrogenation after hot rolling as the time necessary for hydrogen removal varies with the square of the plate thickness and hence these thicker plate sections are sensitive to the dissolved hydrogen content.

Production of sour service pressure vessel grade steels therefore, necessitates not only stringent casting and chemistry control to minimize centerline segregation but also minimize dissolved hydrogen during steelmaking and casting.

Thus there is a need in the art for HIC-resistant, high toughness pressure vessel grade plates and a steel alloy for use therein.

SUMMARY OF THE INVENTION

The present inventions relates to a steel alloy composition comprising, in weight percent: C: 0.10-0.135, Mn: 0.8-1.2, P: 0.012 max, S: 0.002 max, Si: 0.30-0.40, Cu: 0.20-0.35, Ni: 0.15-0.25, Al: 0.02-0.05, Nb: 0.015-0.030, Mo: 0.06-0.09, the remainder iron and other unavoidable impurities. The composition has a CE between 0.269-0.393 and a Pcm between 0.167-0.236. The alloy has a hydrogen induced cracking (HIC) resistance such that the alloy has a Crack Length Ratio (CLR), of ≤15%, a Crack Sensitivity Ratio (CSR) of ≤5%, and a Crack Thickness Ratio (CTR); of ≤2%, when tested as per NACE 0284 specification in solution A. The alloy further has a CVN impact energy of at least 75 ft-lb at −20 F.

The alloy may have a CLR of ≤5%, a CSR of ≤2%, and a CTR of ≤1%. Preferably, the alloy may have a CLR of 0%, a CSR of 0%, and a CTR of 0%.

In another embodiment, the steel alloy composition may comprise, in weight percent: C: 0.11-0.13, Mn: 0.8-1.2, P: 0.012 max, S: 0.002 max, Si: 0.30-0.40, Cu: 0.25-0.35, Ni: 0.15-0.25, Al: 0.02-0.04, Nb: 0.016-0.020, Mo: 0.06-0.08, the remainder iron and other unavoidable impurities.

In yet another embodiment, the steel alloy composition may comprise, in weight percent: C: 0.115-0.135, Mn: 1.0-1.2, P: 0.012 max, S: 0.002 max, Si: 0.03-0.04, Cu: 0.25-0.32, Ni: 0.15-0.22, Al: 0.025-0.045, Nb: 0.015-0.03, Mo: 0.06-0.09, the remainder iron and other unavoidable impurities.

In still another embodiment, the steel alloy composition may comprise, in weight percent: C: 0.11-0.13, Mn: 1.0-1.20, P: 0.01 Max, S: 0.001 Max, Si: 0.30-0.40, V: 0.01 Max, Cu: 0.20-0.30, Ni: 0.15-0.22; Al: 0.020-0.050, Nb: 0.012-0.020, Ti: 0.020 Max, Ca: 0.0015-0.0030; and wherein the composition may have a CE between 0.277-0.377 and a Pcm between 0.173-0.209.

In a further embodiment, the steel alloy composition may comprise, in weight percent: C: 0.12, Mn: 1.19, P: 0.013, S:

0.001, Si: 0.34, Cu: 0.24, Ni: 0.15; Nb: 0.017, Mo: 0.079, Al: 0.025, Ca: 0.0010; and wherein the composition may have a CE of 0.342.

The steel alloy may further have a CVN impact energy of at least 75 ft-lb at −80 F and more preferably a CVN impact energy of at least 200 ft-lb at −20 F. The steel alloy may have a homogenous polygonal ferrite-pearlite microstructure throughout.

DETAILED DESCRIPTION OF THE INVENTION

The present invention is a lower carbon steel alloy with specific substitutional alloying additions. The alloy is useful in the production of ASTM A516 grade pressure vessel steel plates with excellent HIC resistance. The material has a ferrite-pearlite microstructure appropriate for resisting hydrogen induced cracking, with isolated ferrite and pearlite constituents and no continuous pearlite bands. The material exhibits significant low temperature toughness.

The inventive alloy has, in its broadest form, a composition comprising: C: 0.10-0.1359, Mn: 0.8-1.2, P: 0.012 max, S: 0.002 max, Si: 0.30-0.40, Cu: 0.20-0.35, Ni: 0.15-0.25, Al: 0.02-0.05, Nb: 0.015-0.030, Mo: 0.06-0.09, the remainder iron and other unavoidable impurities.

In another embodiment, the inventive alloy has a composition comprising: C: 0.11-0.13, Mn: 0.8-1.2, P: 0.012 max, S: 0.002 max, Si: 0.30-0.40, Cu: 0.25-0.35, Ni: 0.15-0.25, Al: 0.02-0.04, Nb: 0.016-0.020, Mo: 0.06-0.08, the remainder iron and other unavoidable impurities.

In a preferred embodiment, the inventive alloy has a composition comprising: C: 0.115-0.135, Mn: 1.0-1.2, P: 0.012 max, S: 0.002 max, Si: 0.03-0.04, Cu: 0.25-0.32, Ni: 0.15-0.22, Al: 0.025-0.045, Nb: 0.015-0.03, Mo: 0.06-0.09, the remainder iron and other unavoidable impurities.

The CE carbon equivalence of the alloys is determined by the formula (where the concentration of the elements is in wt. %):

$$CE=C+Mn/6+(Cu+Ni)/15+(Mo+V+Cr)/5$$

The Pcm carbon equivalence of the alloys is determined by the formula:

$$Pcm=C+S304+(Mn+Cu+Cr)/20+Ni/60+Mo/15+V/10+5B$$

Broadly, the alloys have a CE between 0.269-0.393 and a Pcm between 0.167-0.236.

Production of slabs with the inventive low-carbon composition revealed excellent internal quality of slabs and final plate properties with outstanding HIC resistance. Lowering carbon not only enhanced centerline slab soundness but also low temperature impact toughness in final plate products. Since pressure vessel manufacturing is a weld-intensive fabrication process, a reduced carbon equivalence in steel as in the case of current invention provides for significant reduction and even elimination of post weld heat treatment processes when using the present alloy.

Evaluation of Pressure Vessel Plates for HIC Resistance

Figure 1A:
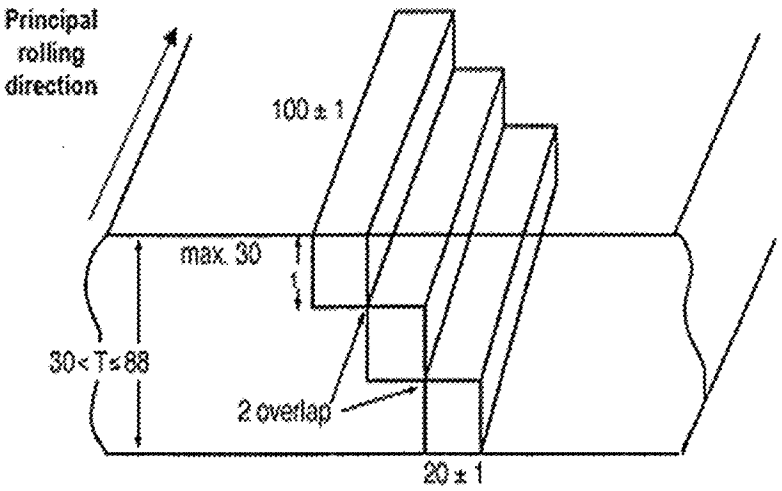
FIG. 1*a* is a depiction of a slab of steel from which the test samples are taken for HIC testing.
Figure 1B:
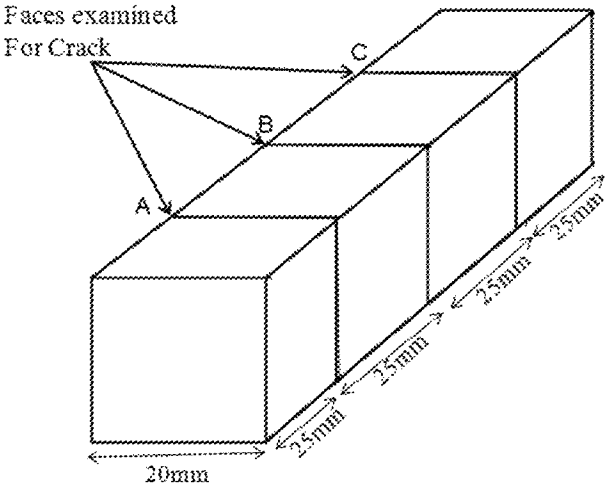
FIG. 1*b* shows the manner in which the test pieces are sectioned for metallographic evaluation for any cracks generated during HIC testing.

A measure of successful HIC resistance of pressure vessels and pipelines is usually assessed through standardized corrosion tests such as NACE™ 0284-13 on plate samples which evaluate the steel's susceptibility to HIC in reproducible service conditions. Details of test sample preparation, test solution and testing is described herein below in the specification. Full thickness (≤30 mm) test samples of 100±1 mm long and 20±1 mm wide with longitudinal axis aligned with the principal rolling direction are cut from the plate. For plates thicker than 30 mm, overlapping samples are taken till the whole thickness is covered in order to ensure central region of the plate is represented. FIG. 1*a* is a depiction of a slab of steel from which the test samples are taken, specifically indicating the overlapping regions from which the samples are taken when the plate exceeds 30 mm. The test samples are immersed in a sealed vessel containing 5% NaCl and 0.5% acetic acid in distilled water and purged with $H_2S$ gas resulting in a pH of 3. After 96 hrs of exposure to the corrosive test solution termed 'Solution A', the test pieces are sectioned for testing. FIG. 1*b* shows the manner in which the test pieces are sectioned for metallographic evaluation for any cracks generated. Reference letters A, B and C indicate the faces examiner/tested for cracks. Solution A offers the most severe corrosive atmosphere and the test itself is very rigorous in evaluating HIC resistance.

Figure 1C:
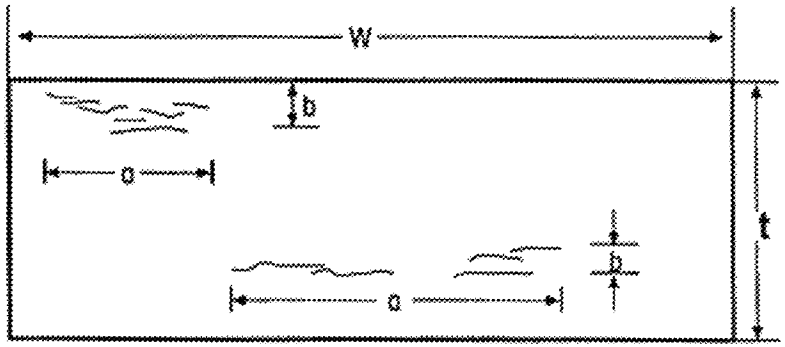
FIG. 1*c* depicts the face of each piece to be analyzed and describes the equations used to calculate CLR, CSR and CTR.
Figure 2A:
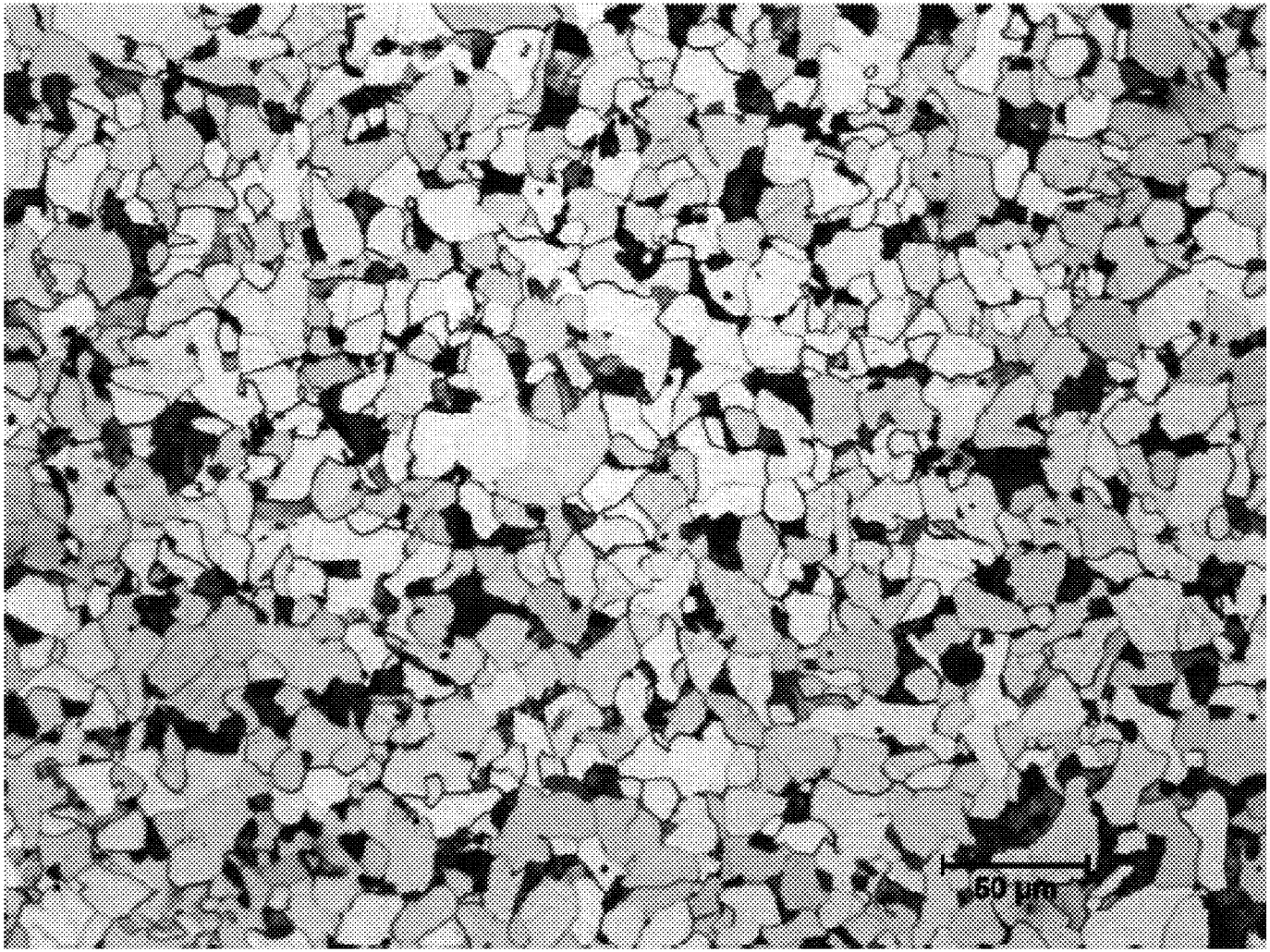
FIG. 2*a* is a photomicrograph of the microstructures of a normalized and stress relieved plate of a higher carbon alloy, near the surface of the plate.
Figure 2B:
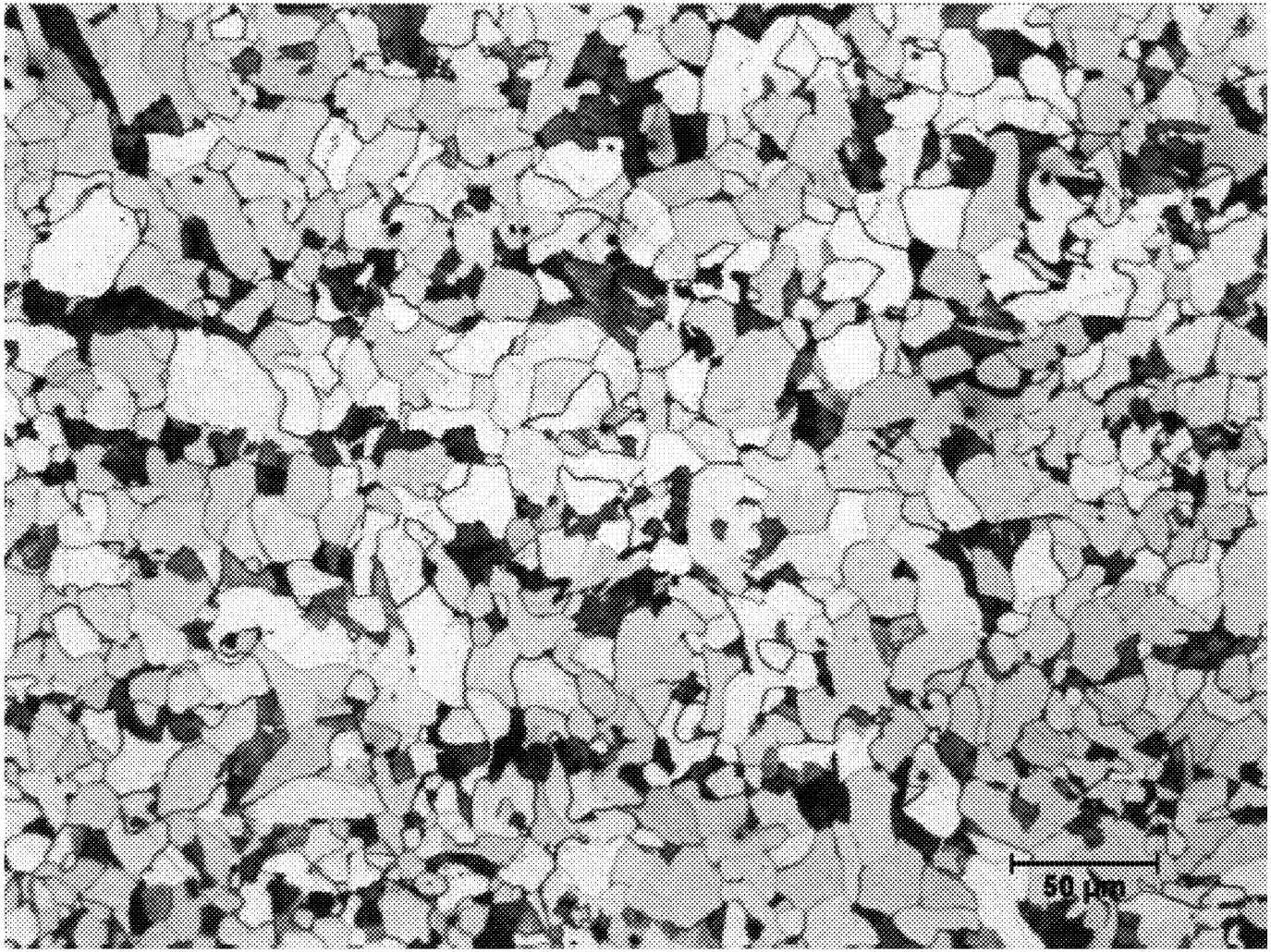
FIG. 2*b* is a photomicrograph of the microstructures of a normalized and stress relieved plate of a higher carbon alloy, near the center of the plate.
Figure 2C:
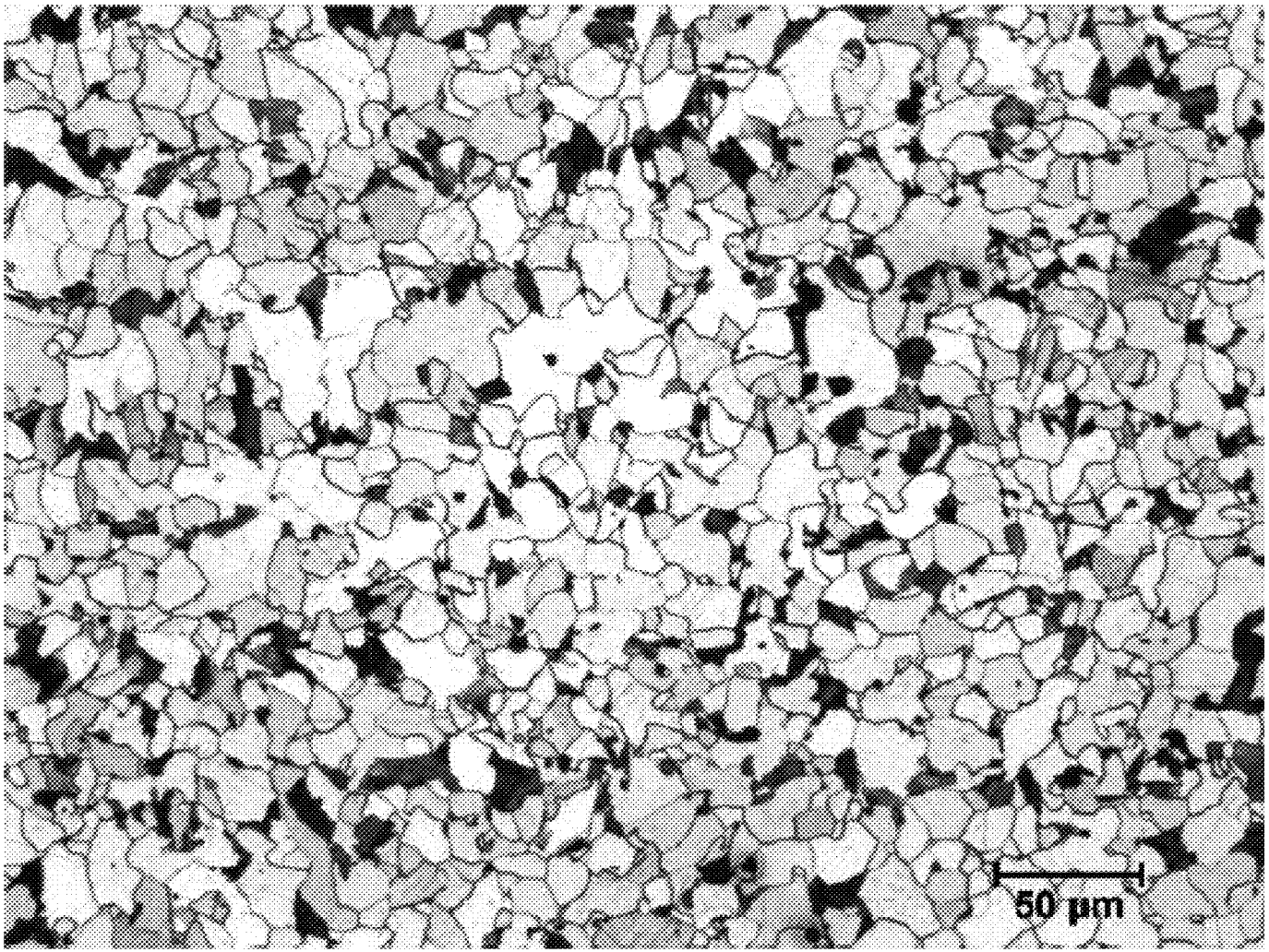
FIG. 2*c* is a photomicrograph of the microstructures of a normalized and stress relieved plate of a lower carbon alloy, near the surface of the plate.
Figure 2D:
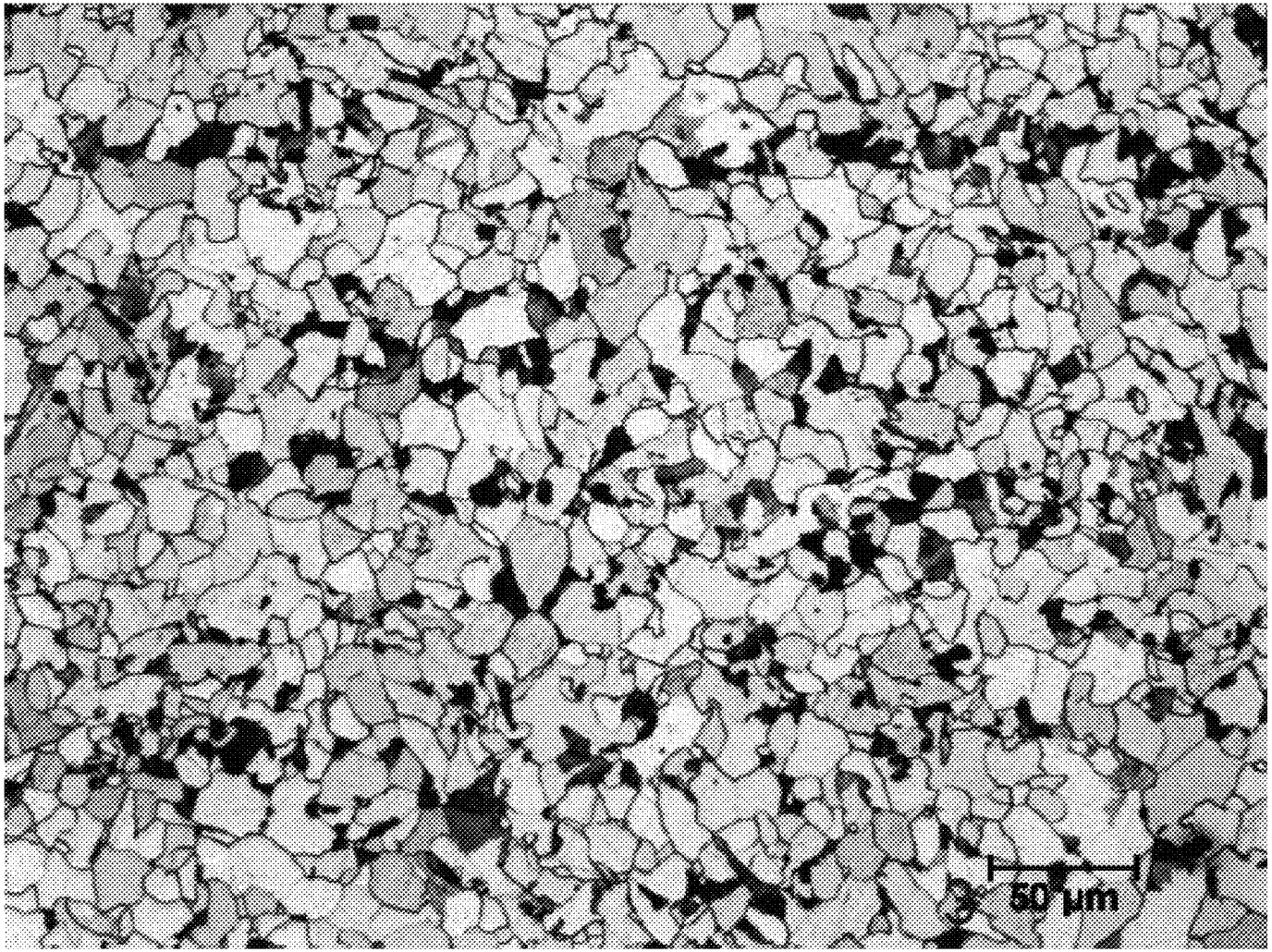
FIG. 2*d* is a photomicrograph of the microstructures of a normalized and stress relieved plate of a lower carbon alloy, near the center of the plate.

A measure of successful HIC resistance is interpreted as an acceptable maximum values indicated by parameters the parameters Crack Length Ratio (CLR), Crack Sensitivity Ratio (CSR) and Crack Thickness Ratio (CTR) using crack dimensions as indicated in FIG. 1*c*. FIG. 1*c* depicts the face of each piece to be analyzed and describes the equations used to calculate CLR, CSR and CTR. The face of each piece to be analyzed has a width W and a thickness t. The CLR is defined as the sum of the width dimensions of all cracked sections "a" (i.e. Σ a) divided by the face width W and multiplied by 100 to result in a percentage. The CSR is sum of the width dimensions of each cracked section "a" times the thickness of that section "b" for all cracked sections (i.e. Σ (a×b)), which sum is then divided by the product of the face width W and the face thickness t (i.e. W×t) and again multiplied by 100 to result in a percentage. Finally, the CTR is defined as the sum of the thickness dimensions of all cracked sections "b" (i.e. Σ b) divided by the face thickness t and multiplied by 100 to result in a percentage. API and International standards stipulates CLR, CSR and CTR values of ≤15%, ≤5% and ≤2% respectively for HIC resistant linepipe grades. The present inventive alloys meet and/or exceed these criterion.

Standard pressure vessel grade steels allows relatively high carbon contents (up to 0.31 wt. %) but, with increased carbon content, controlling centerline segregation becomes a difficult task because of increased occurrences of shrinkage cavities. The present inventive allow has a lower carbon content and is suitable for the production of ASTM A516-60/65/70 grade sour service slabs. The reduction in tensile strength due to the lowering of carbon has been offset by substitutional alloying such as Cu, Ni etc.

Chemistry Design and Processing

Test ingots were made at ArcelorMittal Global R&D using a low-C chemistry and a slightly higher carbon chemistry keeping other elemental alloying almost the same. The two different carbon levels were chosen to examine microstructural and mechanical property evolution in normalized and stress relieved conditions and to assess suitability of the chemistry for various ASTM A516 grades. The compositions of the heats are as given in Table 1.

TABLE 1

| | Invention Low C | Compare High C |
|---|---|---|
| C | 0.12 | 0.17 |
| Si | 0.34 | 0.34 |
| Mn | 1.19 | 0.90 |
| P | 0.013 | 0.012 |
| S | 0.001 | 0.001 |
| Cu | 0.24 | 0.20 |
| Ni | 0.15 | 0.15 |
| Nb | 0.017 | 0.018 |
| Mo | 0.079 | 0.062 |
| Al | 0.025 | 0.030 |
| Ca | 0.0010 | 0.0010 |
| CE | 0.360 | 0.402 |

Steel ingots were hot rolled to 50 mm thick finished plates simulating actual mill hot rolling conditions. Rolled plates were normalized at 900 C for 2 hours and subsequently stress relieved at 610 C for 2 hours using a rigorous heating and cooling rate of 60 C/hr to and from the stress-relieving temperature. After heat treatment, test samples were cut for microstructure and mechanical property evaluation. Samples from full thickness plates underwent corrosion (HIC) tests.

Microstructure and Mechanical Properties of Trial Plates

FIGS. 2*a*-2*d* are photomicrographs of the microstructures of normalized and stress relieved plates of the two different grades (higher carbon 2*a* and 2*b* and lower carbon 2*c* and 2*d*) at both the near surface area (2*a* and 2*c*) and in the center area (2*b* and 2*d*). The images were created using a 2% Nital etch and are at 200× magnification. Both samples present a homogenous polygonal ferrite-pearlite microstructure from the surface to the center of the plates. Pearlite constituents appear as isolated grains and not in continuous clusters or bands. No hard microconstituents were also observed in the microstructures.

Table 2 lists the tensile test results from normalized and stress relieved plates from the two different compositions given in Table 1. Stress relieving did not seem to cause a significant decrease in the yield and tensile strengths for both the steels probably due to the microstructure and leaner alloying. Both steels meet the ASTM A516-65/70 properties.

TABLE 2

| | YS, ksi (MPa) | | TS, ksi (MPa) | | |
|---|---|---|---|---|---|
| Steel | Normalizing | after stress relieving | Normalizing | after stress relieving | EL % |
| Low-C | 48 (331) | 45.8 (316) | 71.5 (493) | 69.5 (479) | 42 |
| High-C | 48.3 (333) | 46 (317) | 73 (503) | 71.5 (493) | 37 |

Figure 3:
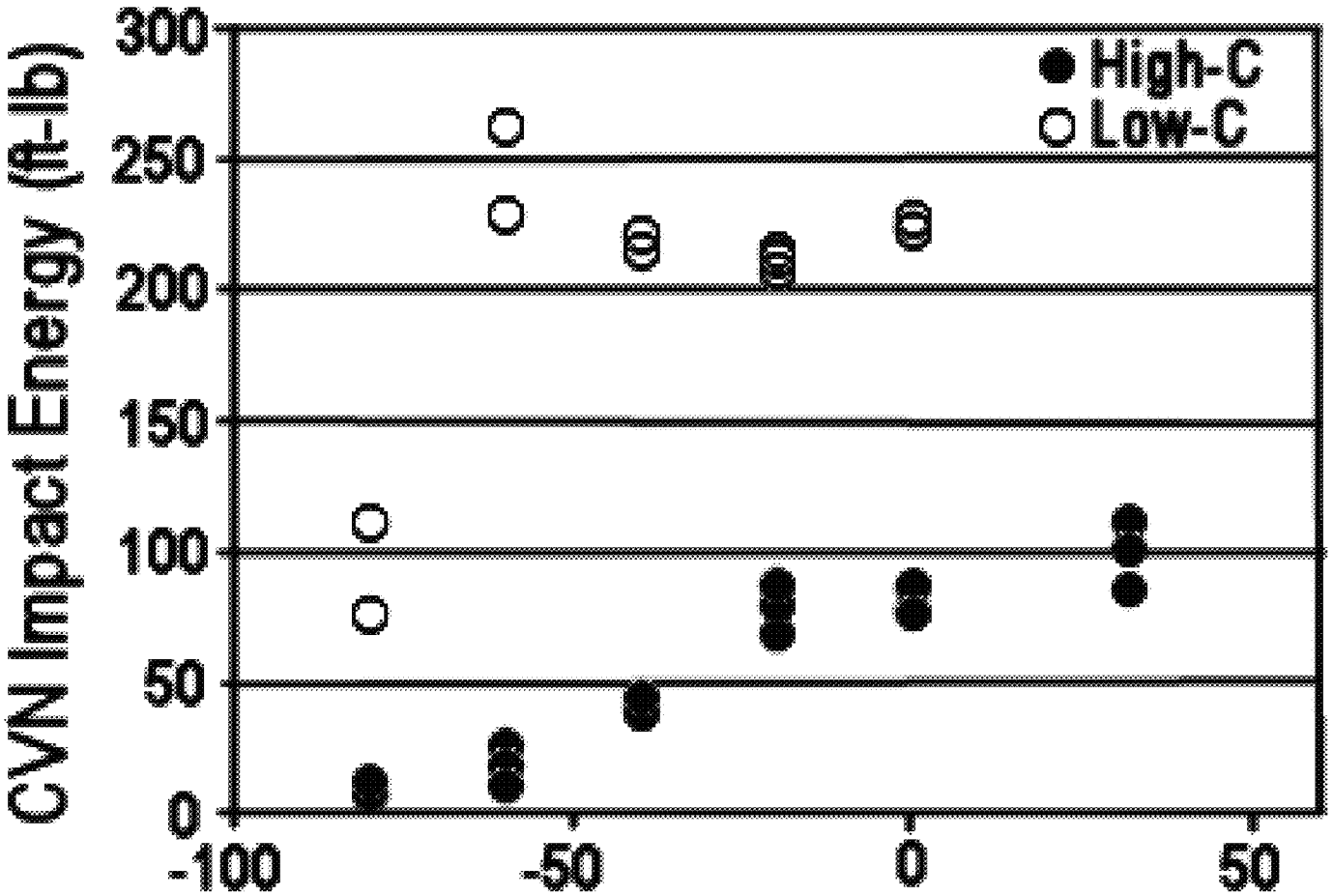
FIG. 3 is a graph plotting the CVN impact energy values on the y-axis versus different test temperatures on the x-axis for both the low and high carbon steels after normalizing and stress relieving.

FIG. 3 shows the CVN impact energy values at different test temperatures for both the steels after normalizing and stress relieving. Both the steels meet most the of the toughness requirements for pressure vessel applications. However, low-carbon steel offers significantly better impact toughness values at low temperatures and hence applicability for severe low temperature applications. Specifically, the alloys exhibit a CVN impact energy of at least 75 ft-lb at −20 F. More preferably, the alloys exhibit a CVN impact energy of at least 75 ft-lb at −80 F, and a CVN impact energy of at least 200 ft-lb at −20 F.

HIC Test Results as Per NACE™ 0284-2003

Full thickness normalized and stress relieved plate samples from both the steels were tested to evaluate the microstructural response to HIC resistance. The inventive alloys have a CLR of ≤15%, more preferably ≤5%, and most preferably 0%. The inventive alloys have a CSR of ≤5%, more preferably 2≤%, and most preferably 0%. The inventive alloys have a CTR of ≤2%, more preferably ≤1%, and most preferably 0%. Table 3 details the HIC test results from all the steel plates. None of the test samples revealed any microscopic cracks after HIC tests. The absence of any microcrack after the severe corrosion test (Solution A) indicates excellent tolerance to hydrogen-induced-cracking for the inventive compositions and their polygonal ferrite-pearlite microstructures.

TABLE 3

| Steel | | CLR, % Section A/B/C | CTR, %, Section A/B/C | CSR, % Section A/B/C | Test Conditions |
|---|---|---|---|---|---|
| Low-C | Sample 1 | 0, 0, 0 | 0, 0, 0 | 0, 0, 0 | Initial pH 2.7 $H_2S$ |
| | Sample 2 | 0, 0, 0 | 0, 0, 0 | 0, 0, 0 | saturation pH 2.9, |
| | Sample 3 | 0, 0, 0 | 0, 0, 0 | 0, 0, 0 | End of test pH 3.4 |
| High-C | Sample 1 | 0, 0, 0 | 0, 0, 0 | 0, 0, 0 | Test Temp. 75° F. |
| | Sample 2 | 0, 0, 0 | 0, 0, 0 | 0, 0, 0 | |
| | Sample 3 | 0, 0, 0 | 0, 0, 0 | 0, 0, 0 | |

Slab Internal Quality Assessment—Macrostructure

Longitudinal and transverse sections were cut from representative slabs after casting and macroetched using warm 30-35% aqueous HCl solution to reveal cast structure for indications of macrosegregation and shrinkage cavities. Analysis indicates that the slabs have a sound and clean internal structure. Transverse sections at triple points and mid section of cast slabs were also macroetched to examine centerline conditions as these are the areas for the final liquid to solidify. Analysis shows a dean centerline condition with columnar grains extending almost to the mid-section of slabs. The near-absence of equiaxed grains at the center indicated excellent superheat control during casting.

Slab Internal Quality—Microstructure

In order to evaluate the internal cleanliness and the mechanical properties including HIC that can be achieved in the final rolled products, slab samples from the cast heats were processed at ArcelorMittal Global R&D. The longitudinal macroetched slab sample was machined to 5" thick, 10" long and 10" wide section for hot rolling. The slab sample was hot rolled to plate the same way as the other laboratory slabs closely simulating industrial rolling conditions. The rolled plate was normalized and stress relieved and mechanical properties assessed.

The microstructure indicated a very clean steel with only spherical inclusions and no indications of sulfide stringers or non-metallic inclusion clusters. SEM-EDS microanalysis and energy dispersive X-ray mapping performed in a JEOL-JSM 6060 scanning electron microscope showed globular inclusions to be mainly fine Ca-aluminate, alumina and very few duplex oxy-sulfides. The size of most of the oxide or oxy-sulfide inclusions were less than 2 μm. Oxy-sulfide inclusions didn't reveal the presence of Mn within the parameters of the scan, probably because of very low levels of S (<0.001 wt. %) in the steel. It is also important to note that the shape if the inclusions remained globular even after hot rolling and hence rendered the steel less sensitive to HIC.

A lower carbon chemistry with a judicious substitutional alloying additions has been invented for the production of ASTM A516 grade pressure vessel steel plates with HIC resistance. The material has a polygonal ferrite-pearlite microstructure (isolated ferrite and pearlite constituents and pearlite not in continuous bands) which resists hydrogen induced cracking. The material has excellent low temperature toughness. Slabs of the low-carbon composition revealed excellent internal quality and final plate properties with outstanding HIC resistance. Lowering carbon not only enhanced centerline slab soundness but also low temperature impact toughness in final plate products. Since pressure vessel manufacturing is a weld-intensive fabrication process, a reduced carbon equivalence in steel, as is the case with the present invention, will lead to a significant reduction and even elimination of post weld heat treatment process thus favoring the inventive alloy's industrial applicability.

It is to be understood that the disclosure set forth herein is presented in the form of detailed embodiments described for the purpose of making a full and complete disclosure of the present invention, and that such details are not to be interpreted as limiting the true scope of this invention as set forth and defined in the appended claims.

What is claimed is:

1. A steel alloy composition consisting of, in weight percent:

C: 0.10-0.135%,
Mn: 0.8-1.2%,
P: 0-0.012%,
S: 0-0.002%,
Si: 0.30-0.40%,
Cu: 0.15-0.35%,
Ni: 0.15-0.25%,
Al: 0.02-0.05%,
Nb: 0.015-0.030%,
Mo: 0.06-0.09%,
Ca: 0-0.0030%, the remainder being iron and other unavoidable impurities;

wherein said alloy has a homogenous polygonal ferrite-pearlite microstructure throughout wherein the homogenous polygonal ferrite-pearlite microstructure consists of isolated ferrite and pearlite constituents and pearlite not in continuous bands throughout.

2. The steel alloy of claim 1, wherein said composition has a CE between 0.269-0.393 and a Pcm between 0.167-0.236, wherein CE and Pcm are defined as (all elemental concentrations are in wt %):

$$CE=C+Mn/6+(Cu+Ni)/15+(Mo+V+Cr)/5$$

and $$Pcm=C+Si/30+(Mn+Cu+Cr)/20+Ni/60+Mo/15+V/10+5B.$$

3. The steel alloy of claim 1, wherein said alloy having a hydrogen induced cracking (HIC) resistance such that the alloy has a Crack Length Ratio (CLR), of ≤15%, a Crack Sensitivity Ratio (CSR) of ≤5%, and a Crack Thickness Ratio (CTR); of ≤2%.

4. The steel alloy of claim 1, wherein said alloy further having a CVN impact energy of at least 75 ft-lb at −20° F.

5. The steel alloy of claim 2, wherein said alloy further having a CVN impact energy of at least 75 ft-lb at −20° F.

6. The steel alloy of claim 3, wherein said alloy further having a CVN impact energy of at least 75 ft-lb at −20° F.

7. The steel alloy of claim 2, wherein said alloy having a hydrogen induced cracking (HIC) resistance such that the alloy has a Crack Length Ratio (CLR), of ≤15%, a Crack Sensitivity Ratio (CSR) of ≤5%, and a Crack Thickness Ratio (CTR); of ≤2%.

8. The steel alloy of claim 3, wherein said CLR is ≤5%, said CSR is ≤2%, and said CTR is ≤1%.

9. The steel alloy of claim 3, wherein said CLR is 0%, said CSR is 0%, and said CTR is 0%.

10. The steel alloy of claim 1, wherein said composition consists of, in weight percent:

C: 0.11-0.13%,
Mn: 0.8-1.2%,
P: 0-0.012%,
S: 0-0.002%,
Si: 0.30-0.40%,
Cu: 0.25-0.35%,
Ni: 0.15-0.25%,
Al: 0.02-0.04%,
Nb: 0.016-0.020%,
Mo: 0.06-0.08%,
Ca: 0-0.0030%, the remainder being iron and other unavoidable impurities.

11. The steel alloy of claim 1, wherein said composition consists of, in weight percent:

C: 0.115-0.135%,
Mn: 1.0-1.2%,
P: 0-0.012%,
S: 0-0.002%,
Si: 0.30-0.40%,
Cu: 0.25-0.32%,
Ni: 0.15-0.22%,
Al: 0.025-0.045%,
Nb: 0.015-0.03%,
Mo: 0.06-0.09%,
Ca: 0-0.0030%, the remainder being iron and other unavoidable impurities.

12. A steel alloy composition consisting of, in weight percent:

C: 0.11-0.13%,
Mn: 1.0-1.20%,
P: 0-0.01%,
S: 0-0.001%,
Si: 0.30-0.40%,
V: 0-0.01%,
Cu: 0.20-0.30%,
Ni: 0.15-0.22%;
Al: 0.020-0.050%,
Nb: 0.012-0.020%,
Ti: 0-0.020%,
Ca: 0.0015-0.0030, the remainder being iron and other unavoidable impurities; and wherein said composition has a CE between 0.277-0.377 and a Pcm between 0.173-0.209, and said alloy has a homogenous polygonal ferrite-pearlite microstructure throughout wherein the homogenous polygonal ferrite-pearlite microstructure consists of isolated ferrite and pearlite constituents and pearlite not in continuous bands throughout.

13. The steel alloy of claim 11, wherein said composition consists of, in weight percent:

C: 0.12%,
Mn: 1.19%,
P: 0.013%,
S: 0.001%,
Si: 0.34%,
Cu: 0.24%,
Ni: 0.15%;
Nb: 0.017%,
Mo: 0.079%,
Al: 0.025%,
Ca: 0.0010%, the remainder being iron and other unavoidable impurities; and wherein said composition has a CE of 0.342.

14. The steel alloy of claim 4, wherein said alloy further has a CVN impact energy of at least 75 ft-lb at −80° F.

15. The steel alloy of claim 14, wherein said alloy further has a CVN impact energy of at least 200 ft-lb at −20° F.

16. An ASTM A516 grade pressure vessel steel plate comprising the steel alloy of claim 14.

17. A steel alloy composition comprising, in weight percent:

C: 0.10-0.135%,
Mn: 0.8-1.2%,
P: 0-0.012%,
S: 0-0.002%,
Si: 0.30-0.40%,
Cu: 0.15-0.35%,
Ni: 0.15-0.25%,
Al: 0.02-0.05%,
Nb: 0.015-0.030%,
Mo: 0.06-0.09%,
Ca: 0-0.0030%, the remainder being iron and other unavoidable impurities;

wherein said alloy has a homogenous polygonal ferrite-pearlite microstructure with isolated ferrite and pearlite constituents and pearlite not in continuous bands throughout.

* * * * *